US010289063B2

(12) United States Patent
Sato et al.

(10) Patent No.: US 10,289,063 B2
(45) Date of Patent: May 14, 2019

(54) IMAGE FORMING APPARATUS INCLUDING MAIN CASING, FIRST CARTRIDGE AND SECOND CARTRIDGE

(71) Applicant: Brother Kogyo Kabushiki Kaisha, Nagoya-shi, Aichi-ken (JP)

(72) Inventors: Shougo Sato, Seto (JP); Atsushi Miwa, Anjo (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/927,867

(22) Filed: Mar. 21, 2018

(65) Prior Publication Data

US 2019/0011875 A1 Jan. 10, 2019

(30) Foreign Application Priority Data

Jul. 4, 2017 (JP) ..... 2017-131195

(51) Int. Cl.
*G03G 21/18* (2006.01)
*G03G 21/16* (2006.01)

(52) U.S. Cl.
CPC ..... *G03G 21/1842* (2013.01); *G03G 21/1633* (2013.01); *G03G 2221/183* (2013.01)

(58) Field of Classification Search
CPC ..... G03G 21/1842; G03G 21/1633; G03G 2221/183
See application file for complete search history.

(56) References Cited

U.S. PATENT DOCUMENTS 5,508,785 A 4/1996 Takahashi et al.
2015/0261179 A1* 9/2015 Sato ..... G03G 21/18 399/111
2017/0075293 A1* 3/2017 Fukasawa ..... G03G 21/1647

FOREIGN PATENT DOCUMENTS

JP H08-095467 A 4/1996
JP 2006-259233 A 9/2006

* cited by examiner

*Primary Examiner* — Sandra Brase
(74) *Attorney, Agent, or Firm* — Banner & Witcoff, Ltd.

(57) ABSTRACT

A first guide guides a first cartridge when the first cartridge is mounted onto a main casing. A second guide guides a second cartridge when the second cartridge is mounted onto the main casing. The first and second guides are located in the main casing. A third guide is located at an upstream side of the first guide in a first mounting direction that is a direction in which the first cartridge is guided by the first guide when the first cartridge is mounted onto the main casing. The third guide guides the first cartridge toward the first guide when the first cartridge is mounted onto the main casing. The third guide moves relative to the second guide between a first protruding position at which the third guide protrudes to outside the main casing and a first accommodated position at which the third guide is accommodated in the main casing.

18 Claims, 17 Drawing Sheets

IMAGE FORMING APPARATUS INCLUDING MAIN CASING, FIRST CARTRIDGE AND SECOND CARTRIDGE

CROSS REFERENCE TO RELATED APPLICATIONS

This application claims priority from Japanese Patent Application No. 2017-131195 filed Jul. 4, 2017. The entire content of the priority application is incorporated herein by reference.

TECHNICAL FIELD

This disclosure relates to an image forming apparatus.

BACKGROUND

Conventionally, an image forming apparatus including a main casing, a first cartridge that is mounted on the main casing, and a second cartridge that is mounted on the main casing independently from the first cartridge is known.

The main casing has a first guide guiding the first cartridge and a second guide guiding a second cartridge.

SUMMARY

According to one aspect, this specification discloses an image forming apparatus. The image forming apparatus includes a main casing, a first cartridge, and a second cartridge. The first cartridge is configured to be mounted on the main casing. The second cartridge is configured to be mounted on the main casing independently from the first cartridge. The main casing includes a first guide, a second guide, and a third guide. The first guide is configured to guide the first cartridge when the first cartridge is mounted onto the main casing. The first guide is located in the main casing. The second guide is configured to guide the second cartridge when the second cartridge is mounted onto the main casing. The second guide is located in the main casing. The third guide is located at an upstream side of the first guide in a first mounting direction that is a direction in which the first cartridge is guided by the first guide when the first cartridge is mounted onto the main casing. The third guide is configured to guide the first cartridge toward the first guide when the first cartridge is mounted onto the main casing. The third guide is configured to move relative to the second guide between a first protruding position at which the third guide protrudes to outside the main casing and a first accommodated position at which the third guide is accommodated in the main casing.

BRIEF DESCRIPTION OF THE DRAWINGS

Embodiments in accordance with this disclosure will be described in detail with reference to the following figures wherein.

DETAILED DESCRIPTION

In the image forming apparatus, when the first cartridge and the second cartridge are removed from the main casing, a user cannot easily understand which one of the first guide and the second guide is fitted in one of the first guide and the second guide.

For this reason, the user easily erroneously mounts the first cartridge and the second cartridge onto the main casing.

Thus, it is an example of an object of the disclosure to provide an image forming apparatus which suppresses erroneous mounting of the first cartridge and the second cartridge onto the main casing.

1. Overview of Image Forming Apparatus 1

Figure 1A:
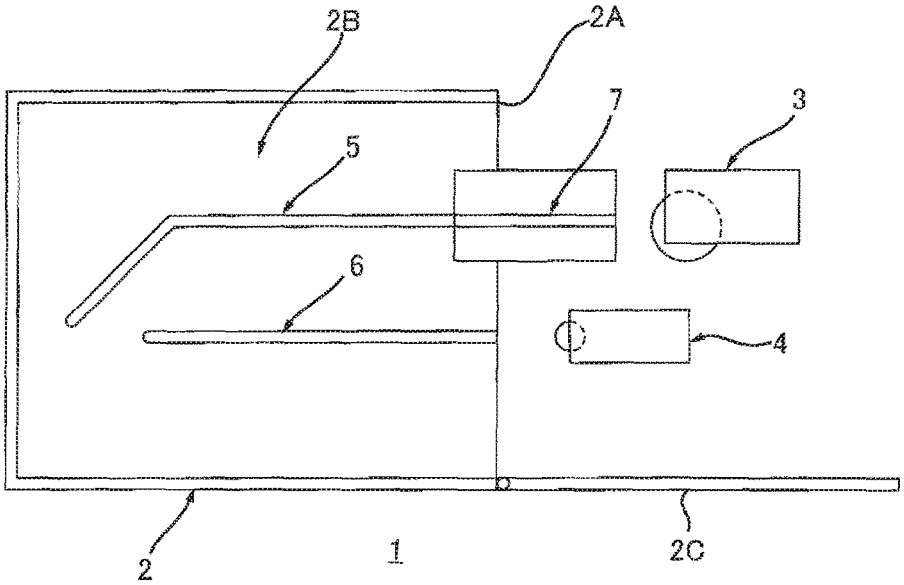
FIG. 1A is a schematic view showing an image forming apparatus according to this disclosure and shows a state where a third guide is located at a first protruding position.
Figure 1B:
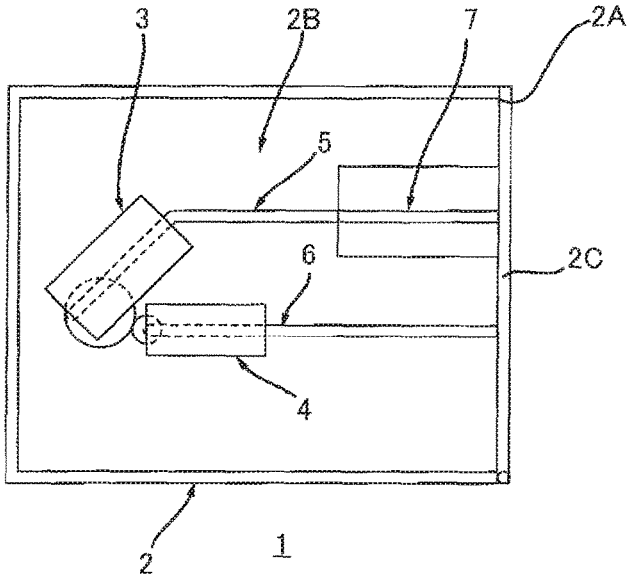
FIG. 1B shows, continuing from FIG. 1A, a state where the third guide is located at a first accommodated position.

An overview of an image forming apparatus 1 will be described while referring to FIGS. 1A and 1B.

The image forming apparatus 1 includes a main casing 2, a first cartridge 3, and a second cartridge 4. The main casing 2 has an opening 2A to mount the first cartridge 3 and the second cartridge 4 onto the main casing 2 and an internal space 2B communicating with the opening 2A. The opening 2A is commonly used when the first cartridge 3 is mounted onto the main casing 2 and when the second cartridge 4 is mounted onto the main casing 2. The internal space 2B accommodates the first cartridge 3 and the second cartridge 4 therein.

1.1 First Cartridge 3

The first cartridge 3 is configured to be mounted on the main casing 2. The first cartridge 3 is accommodated in the internal space 2B through the opening 2A when being mounted onto the main casing 2.

1.2 Second Cartridge 4

The second cartridge 4 is configured to be mounted on the main casing 2 independently from the first cartridge 3. The second cartridge 4 is accommodated in the internal space 2B through the opening 2A when being mounted onto the main casing 2.

1.3 Main Casing 2

The main casing 2 includes a cover 2C, a first guide 5, a second guide 6, and a third guide 7.

1.3.1 Cover 2C

The main casing 2 is configured to move between an open position (see FIG. 1A) at which the opening 2A opens and a closed position (see FIG. 1B) at which the opening 2A is closed.

1.3.2 First Guide 5

The first guide 5 guides the first cartridge 3 when the first cartridge 3 is mounted onto the main casing 2. The first guide 5 is located in the main casing 2.

1.3.3 Second Guide 6

The second guide 6 guides the second cartridge 4 when the second cartridge 4 is mounted onto the main casing 2. The second guide 6 is located in the main casing 2.

1.3.4 Third Guide 7

A third guide 7 is configured to move relative to the second guide 6 between a first protruding position (see FIG. 1A) protruding out of the main casing 2 and a first accommodated position (see FIG. 1B) accommodated in the main casing 2. The third guide 7 guides the first cartridge 3 toward the first guide 5 when the first cartridge 3 is mounted onto the main casing 2, in a state where the third guide 7 is located at the first protruding position. The third guide 7 is located at an upstream side of the first guide 5 in a first mounting direction in a state where the third guide 7 is located at the first protruding position. The first mounting direction is a direction in which the first cartridge 3 is guided by the first guide 5 when the first cartridge 3 is mounted onto the main casing 2. More specifically, the first mounting direction is, when the first cartridge 3 is mounted onto the main casing 2, a moving direction in which the first cartridge 3 moves in the internal space 2B of the main casing 2 along the first guide 5.

2. First Embodiment

An image forming apparatus 10 according to a first embodiment will be described while referring to FIGS. 2 to 5. In the image forming apparatus 10 of the first embodiment, like parts and components similar to members of the above-outlined image forming apparatus 1 are designated by the same reference numerals to avoid duplicating description.

Figure 2:
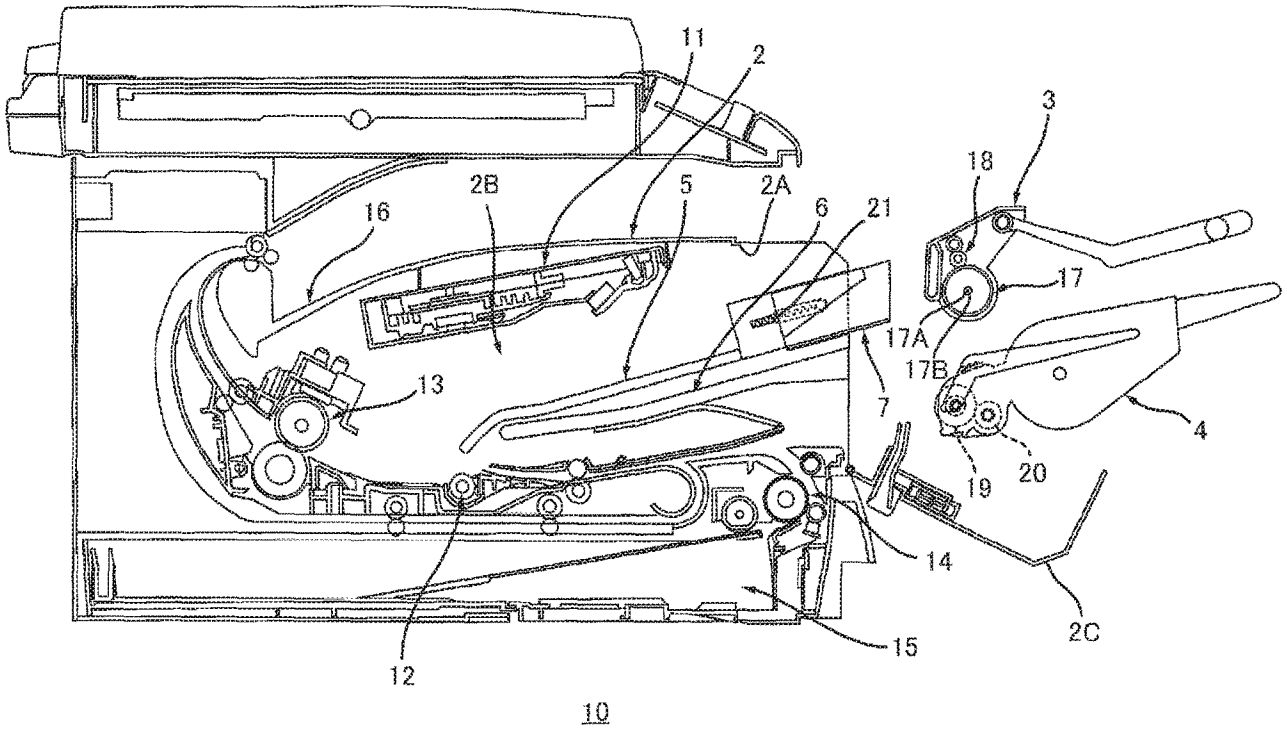
FIG. 2 is a cross-sectional view showing an image forming apparatus according to a first embodiment, and shows a state where the third guide is located at the first protruding position.

As shown in FIG. 2, the image forming apparatus 10 includes the main casing 2, the first cartridge 3, the second cartridge 4, a laser scan unit 11, a transfer roller 12, a fixing unit 13, a paper feeder 14, a paper feed tray 15, a paper discharge tray 16.

2.1 Details of First Cartridge 3

The first cartridge 3 is a drum cartridge. The first cartridge 3 includes a photosensitive drum 17, and a charging roller 18.

The photosensitive drum 17 is configured so that a toner image is formed on a surface of the photosensitive drum 17. The photosensitive drum 17 is rotatable around a rotation axis 17A extending in a width direction. The width direction intersects both the first mounting direction and the upper-lower direction. Preferably, the width direction is perpendicular to both the first mounting direction and the upper-lower direction. The photosensitive drum 17 has a drum shaft 17B extending along an axis line 17A. The photosensitive drum 17 need only be rotatable about the axis line 17A and need not have the drum shaft 17B.

The charging roller 18 is configured to charge the surface of the photosensitive drum 17. The charging roller 18 contacts the surface of the photosensitive drum 17.

2.2 Details of Second Cartridge 4

The second cartridge 4 is a developing cartridge. The second cartridge 4 stores toner. The second cartridge 4 includes a developing roller 19 and a supply roller 20.

The developing roller 19 is configured to supply toner to the photosensitive drum 17. The developing roller 19 contacts the surface of the photosensitive drum 17 in a state where the first cartridge 3 and the second cartridge 4 are mounted on the main casing 2. The developing roller 19 may be in proximity to the surface of the photosensitive drum 17 with a space therebetween in a state where the first cartridge 3 and the second cartridge 4 are mounted on the main casing 2.

The supply roller 20 is configured to supply the toner in the second cartridge 4 to the developing roller 19. The supply roller 20 is located in the second cartridge 4. The supply roller 20 contacts the surface of the developing roller 19.

2.3 Details of Main Casing 2

The main casing 2 accommodates the laser scan unit 11, the transfer roller 12, the fixing unit 13, the paper feeder 14, and the paper feed tray 15. The internal space 2B is located between the fixing unit 13 and the cover 2C and between the laser scan unit 11 and the transfer roller 12. The main casing 2 has the first guide 5, the second guide 6, the third guide 7, and a pressing member 21.

2.3.1 Details of First Guide 5

Figure 3:
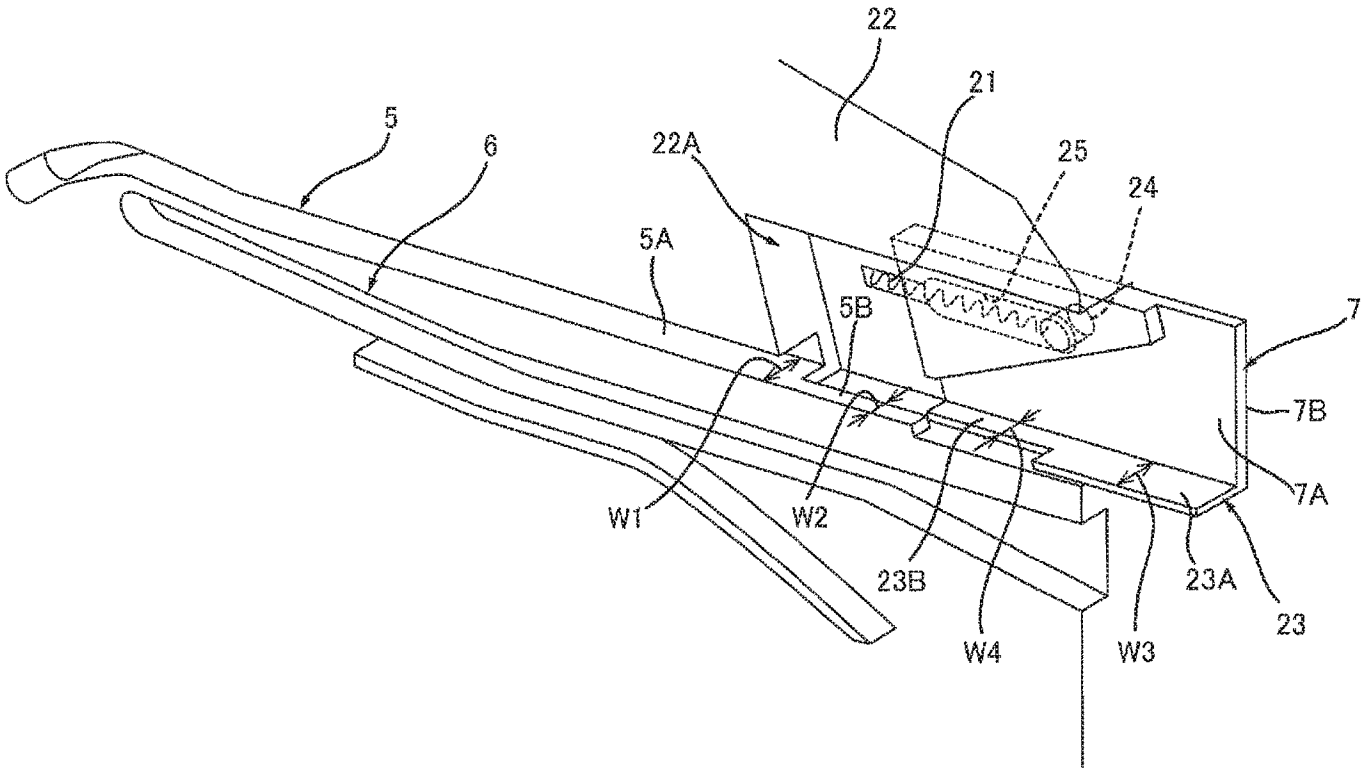
FIG. 3 is a perspective view showing a first guide, a second guide, and the third guide which are shown in FIG. 2.

The first guide 5 guides the first cartridge 3, when the first cartridge 3 is mounted onto the main casing 2, to a position at which the photosensitive drum 17 contacts the transfer roller 12. The first guide 5 extends in the first mounting direction. The first guide 5 is located between the laser scan unit 11 and the second guide 6 in the upper-lower direction. In other words, the first guide 5 is located between the laser scan unit 11 and the second guide 6 in a direction intersecting the first mounting direction and the width direction. As shown in FIG. 3, the first guide 5 is located on an inner surface 22 of the main casing 2 in the width direction. The first guide 5 is a groove. The first guide 5 has a first guide surface 5A and a second guide surface 5B. The first guide 5 may be a rib having the first guide surface 5A and the second guide surface 5B.

When the first cartridge 3 is mounted onto the main casing 2, the first guide surface 5A contacts a part of the first cartridge 3 at a downstream side of the second guide surface 5B in the first mounting direction. The part of the first cartridge 3 is, more specifically, the drum shaft 17B (see FIG. 2). The first guide surface 5A has a first width W1. The width means a length in the width direction.

When the first cartridge 3 is mounted onto the main casing 2, the second guide surface 5B contacts a part of the first cartridge 3 at a downstream side of a fourth guide surface 23B described later and at an upstream side of the first guide surface 5A in the first mounting direction. The second guide surface 5B is located at the upstream side of the first guide surface 5A in the first mounting direction. The second guide surface 5B is continuous with the first guide surface 5A. More specifically, the second guide surface 5B is continuous with an inner side end of the first guide surface 5A in the width direction. The inner side in the width direction is a side close to the first cartridge 3 in the width direction in a state where the first cartridge 3 is accommodated in the main casing 2. The outer side in the width direction is a side distant from the first cartridge 3 in the width direction in a state where the first cartridge 3 is accommodated in the main casing 2. The second guide surface 5B has a second width W2 shorter than the first width W1.

2.3.2 Details of Second Guide 6

As shown in FIG. 2, the second guide 6 guides the second cartridge 4 to a position at which the developing roller 19 contacts the photosensitive drum 17 when the second cartridge 4 is mounted onto the main casing 2. The second guide 6 extends in a second mounting direction. The second mounting direction is a direction in which the second cartridge 4 is guided by the second guide 6 when being mounted onto the main casing 2. More specifically, the second mounting direction is a moving direction in which the second cartridge 4 moves along the second guide 6 in the internal space 2B when being mounted onto the main casing 2. The second guide 6 is located at an opposite side of the laser scan unit 11 with respect to the first guide 5 in the upper-lower direction. As shown in FIG. 3, the second guide 6 is located on the inner surface 22 of the main casing 2 in the width direction. The second guide 6 is a groove. The second guide 6 may be a rib.

2.3.3 Third Guide 7

As shown in FIG. 3, the third guide 7 is supported by the inner surface 22 of the main casing 2. The third guide 7 is located in a recessed part 22A formed in the inner surface 22 of the main casing 2. The third guide 7 slides along the first mounting direction between the first protruding position (see FIG. 4) and the first accommodated position (see FIG. 5). The third guide 7 is located at the first protruding position when the cover 2C is located at an open position. The third guide 7 is located at the first accommodated position when the cover 2C is located at a closed position. The third guide 7 extends in the first mounting direction and the upper-lower direction. The third guide 7 has a planar shape. The third guide 7 has a guide rib 23 and a boss 24. The third guide 7 need only have a third guide surface 23A described later and the fourth guide surface 23B, and may have, in place of the third guide 7, a guide groove having the third guide surface 23A and the fourth guide surface 23B.

The guide rib 23 is located at a lower end of the third guide 7. The guide rib 23 protrudes from an inner surface 7A of the third guide 7. The guide rib 23 has the third guide surface 23A and the fourth guide surface 23B. More specifically, the third guide 7 has the third guide surface 23A and the fourth guide surface 23B.

When the first cartridge 3 is mounted onto the main casing 2, the third guide surface 23A contacts a part of the third cartridge 3 at an upstream side of the fourth guide surface 23B in the first mounting direction. The third guide surface 23A extends in the first mounting direction and extends in the width direction. The third guide surface 23A has a third width W3.

When the first cartridge 3 is mounted onto the main casing 2, the fourth guide surface 23B contacts a part of the first cartridge 3 at a downstream side of the third guide surface 23A and at an upstream side of the second guide surface 5B in the first mounting direction. The fourth guide surface 23B is located in the first mounting direction on the downstream side of the third guide surface 23A. The fourth guide surface 23B is continuous with the third guide surface 23A. More specifically, the fourth guide surface 23B is continuous with the outer side end of the third guide surface 23A in width direction. The fourth guide surface 23B is located at a position different from the second guide surface 5B in the width direction in a state where the third guide 7 is located at the first protruding position. In this manner, the fourth guide surface 23B is located outside the second guide surface 5B in the width direction in a state where the third guide 7 is located at the first accommodated position. In other words, the fourth guide surface 23B is located at an opposite side of the first cartridge 3 with respect to the second guide surface 5B in the width direction in a state where the first cartridge 3 is accommodated in the main casing 2. The fourth guide surface 23B extends in the first mounting direction and extends in the width direction. The fourth guide surface 23B has a fourth width W4 shorter than the third width W3. The fourth guide surface 23B is continuous with the second guide surface 5B in the first mounting direction in a state where the third guide 7 is located at the first protruding position. In this case, the fourth guide surface 23B and the second guide surface 5B may be substantially continuous with each other as long as the fourth guide surface 23B and the second guide surface 5B can pass (hand over) a part of the first cartridge 3 to each other in the first mounting direction. More specifically, the fourth guide surface 23B and the second guide surface 5B may be separated from each other at a small interval enough to pass a part of the first cartridge 3 to each other in the first mounting direction. Preferably, the fourth guide surface 23B is located at a position different from the second guide surface 5B in the width direction, and the fourth guide surface 23B is continuous with the second guide surface 5B without an interval, in a state where the third guide 7 is located at the first protruding position. In this manner, the third guide 7 and the first guide 5 are continuous with each other in the first mounting direction in a state where the third guide 7 is located at the first protruding position.

The boss 24 protrudes from an outer surface 7B of the third guide 7. The boss 24 extends in the width direction. The boss 24 has a columnar shape. The boss 24 is fitted in an elongated hole 25 in the recessed part 22A. The elongated hole 25 extends in the first mounting direction. The boss 24 is fitted in the elongated hole 25 to enable the third guide 7 to move in the first mounting direction.

2.3.4 Pressing Member 21

The pressing member 21 presses the third guide 7 located at the first accommodated position toward the first protruding position. More specifically, the pressing member 21 is elastically deformed in the moving direction of the third guide 7. More specifically, the pressing member 21 is a spring. The pressing member 21 extends in the moving direction of the third guide 7. The pressing member 21 contacts the boss 24. The pressing member 21 is compressed in the moving direction of the third guide 7 in a state where the third guide 7 is located at the first accommodated position. The pressing member 21 presses the boss 24 by elastic force while being compressed. The pressing member 21 presses the boss 24 to press the third guide 7 toward the first protruding position in a state where the third guide 7 is located at the first accommodated position.

2.4 Laser Scan Unit 11, Transfer Roller 12, Fixing Unit 13, Paper Feeder 14, Paper Feed Tray 15, and Paper Discharge Tray 16

Figure 5:
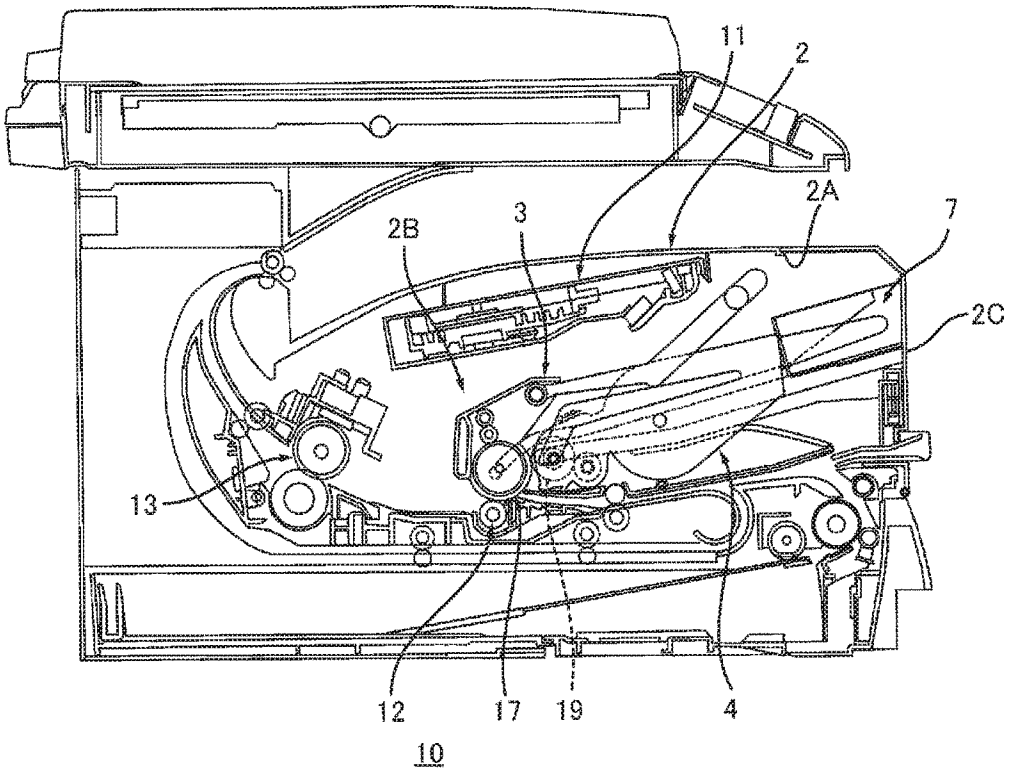
FIG. 5 shows a state where, continuing from FIG. 4, the second cartridge is mounted on the casing.

As shown in FIG. 5, the laser scan unit 11 is configured to expose the surface of the photosensitive drum 17. The transfer roller 12 is configured to transfer a toner image formed on the surface of the photosensitive drum 17 onto a sheet of paper. The transfer roller 12 contacts the surface of the photosensitive drum 17 in a state where the first cartridge 3 is mounted on the main casing 2. The fixing unit 13 is configured to heat and press the sheet of paper to which the toner image is transferred to fix the toner image on the sheet of paper. The paper feeder 14 is configured to supply a sheet of paper in the paper feed tray 15 into between the photosensitive drum 17 and the transfer roller 12. The paper feed tray 15 is configured to store a sheet of paper. The paper discharge tray 16 is configured to receive a discharged sheet of paper having passed through the fixing unit 13.

2.5 Mounting of First Cartridge 3 and Second Cartridge 4

Mounting of the first cartridge 3 and the second cartridge 4 onto the main casing 2 will be described below. The second cartridge 4 is mounted onto the main casing 2 after the first cartridge 3 is mounted onto the main casing 2.

In order to mount the first cartridge 3 and the second cartridge 4 onto the main casing 2, as shown in FIG. 2, a user locates the cover 2C at an open position.

At this time, the cover 2C is located at the open position, and the third guide 7 moves relative to the second guide 6 and is located at the first protruding position.

In this manner, the user can realize that the first cartridge 3 should be fitted in the third guide 7, not in the second guide 6. This is an effect obtained because the third guide 7 protrudes from the internal space 2B and also an effect obtained because the third guide 7 moves. This is because the user tends to pay attention to a moving object.

Figure 4:
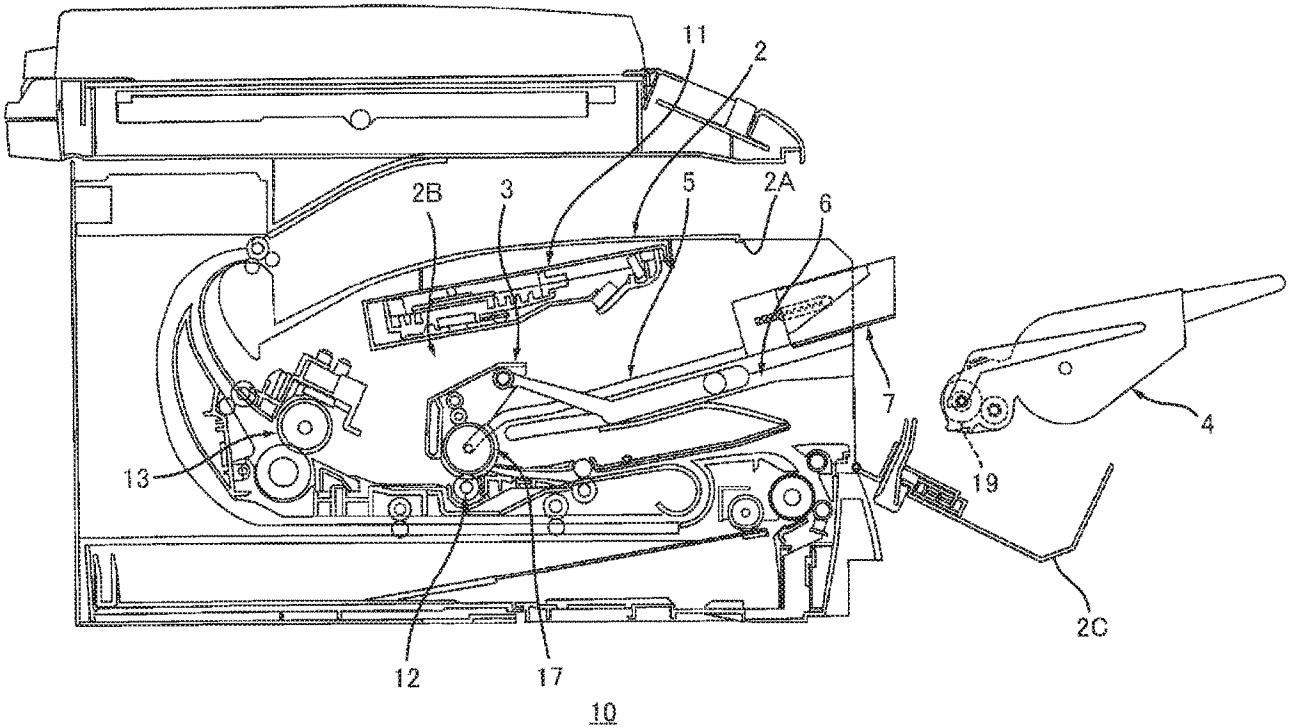
FIG. 4 is an explanatory diagram for explaining mounting of the first cartridge and the second cartridge onto a casing, and shows a state where the first cartridge is mounted on the casing.

When the user fits the first cartridge 3 in the third guide 7 and presses the first cartridge 3 toward the internal space 2B of the main casing 2, the first cartridge 3 is guided by the third guide 7, guided by the first guide 5, and, as shown in FIG. 4, located at a position at which the photosensitive drum 17 contacts the transfer roller 12.

In this manner, the mounting of the first cartridge 3 onto the main casing 2 is completed.

When the user fits the second cartridge 4 in the second guide 6 and presses the second cartridge 4 toward the internal space 2B of the main casing 2, as shown in FIG. 5, the second cartridge 4 is guided by the second guide 6 and located at a position at which the developing roller 19 contacts the photosensitive drum 17.

In this manner, the mounting of the second cartridge 4 onto the main casing 2 is completed.

Thereafter, when the user locates the cover 2C at a closed position, the cover 2C contacts the third guide 7 so as to move the third guide 7 relative to the second guide 6 and locate the third guide 7 at the first accommodated position, and to locate the cover 2C at the closed position.

In this manner, the mounting of the first cartridge 3 and the second cartridge 4 onto the main casing 2 is completed.

2.6 Operations and Advantageous Effects

According to the image forming apparatus 10, as shown in FIG. 2, when the first cartridge 3 and the second cartridge 4 are removed from the main casing 2, the third guide 7 is located at the first protruding position to enable the user to recognize that the third guide 7 or the second cartridge 4 should be fitted in the third guide 7. When the cover 2C opens, the third guide 7 moves to the first protruding position. For this reason, the user easily pays attention to the moving third guide 7. In this manner, the user can recognize that the first cartridge 3 or the second cartridge 4 should be fitted in the third guide 7.

In this manner, in comparison with a case in which any one of the first cartridge 3 and the second cartridge 4 is fitted in any one of the first guide 5 and the second guide 6, a user is prevented from erroneously fitting the first cartridge 3 in the second guide 6 and from erroneously fitting the second cartridge 4 in the second guide 6 before fitting the first cartridge 3 in the first guide 5.

As a result, the first cartridge and the second cartridge can be mounted on the main casing correctly.

When the user understands that the second cartridge 4 should be mounted onto the main casing 2 after the first cartridge 3 is mounted onto the main casing 2, by locating the third guide 7 at the first protruding position, the user can recognize that the first cartridge 3 should be fitted in the third guide 7.

In this case, the user can mount the second cartridge 4 onto the main casing 2 through the second guide 6, after mounting the first cartridge 3 onto the main casing 2 through the third guide 7 and the first guide 5.

As a result, the first cartridge and the second cartridge can be prevented from being erroneously mounted onto the main casing.

3. Second Embodiment

An image forming apparatus 30 according to a second embodiment will be described while referring to FIGS. 6A to 17. In the image forming apparatus 30 of the second embodiment, like parts and components similar to members of the above-outlined image forming apparatus 1 are designated by the same reference numerals to avoid duplicating description.

Figure 6A:
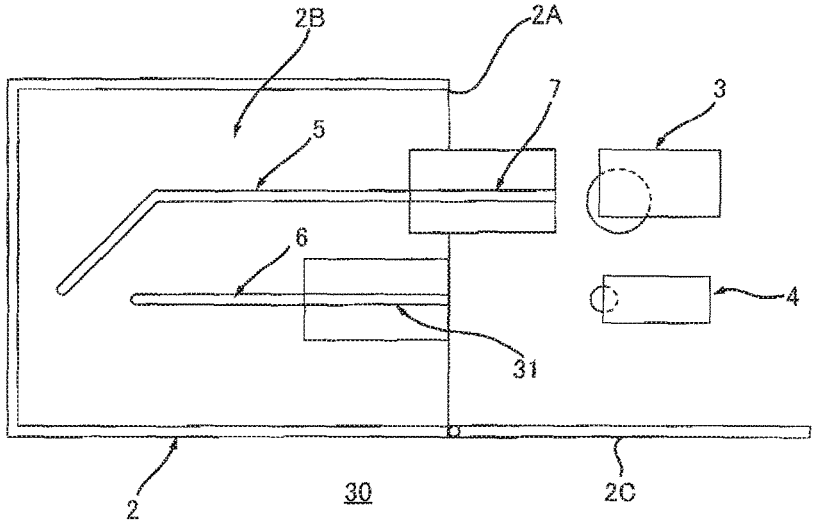
FIG. 6A is a schematic view showing an image forming apparatus of a second embodiment, and shows a state where the third guide is located at the first protruding position and a fourth guide is located at a second accommodated position.
Figure 6B:
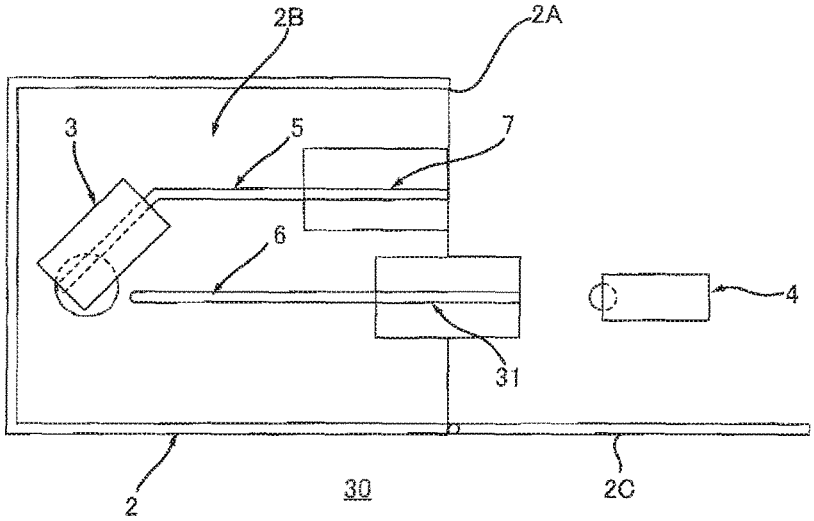
FIG. 6B shows a state where, continuing from FIG. 6A, the third guide is located at the first accommodated position and the fourth guide is located at the second protruding position.

As shown in FIG. 6A and FIG. 6B, the main casing 2 further includes a fourth guide 31. The fourth guide 31 is located at an upstream side of the second guide 6 in the second mounting direction. The fourth guide 31 is configured to move relative to the first guide 5 between a second protruding position (see FIG. 6B) protruding out of the main casing 2 and a second accommodated position (see FIG. 6A) accommodated in the main casing 2.

As shown in FIG. 6A, the fourth guide 31 is located at the second accommodated position when the third guide 7 is located at the first protruding position. As shown in FIG. 6B, the fourth guide 31 is located at the second protruding position when the third guide 7 is located at the first accommodated position. The fourth guide 31 guides the second cartridge 4 toward the second guide 6 when the second cartridge 4 is mounted onto the main casing 2.

A detailed structure of an image forming apparatus 30 according to the second embodiment will be described.

3.1 Details of Main Casing 2

Figure 7:
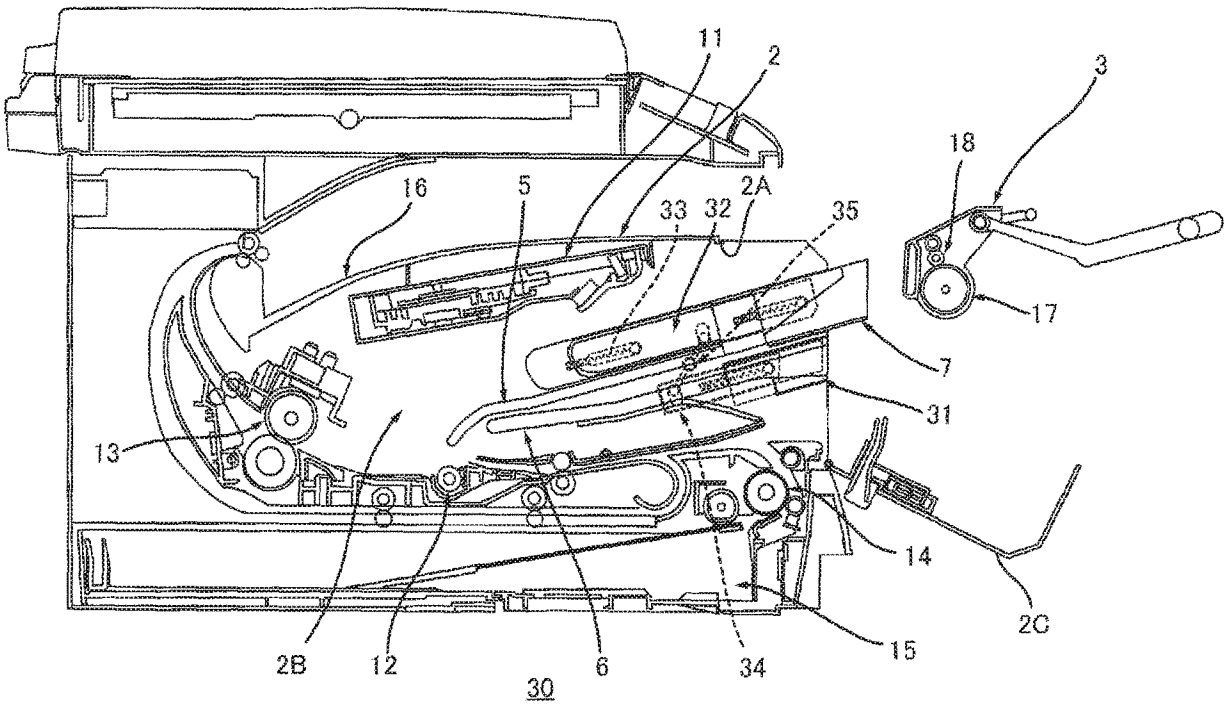
FIG. 7 is a cross-sectional view showing the image forming apparatus according to the second embodiment, and shows a state where the third guide is located at the first protruding position and the fourth guide is located at the second accommodated position.

As shown in FIG. 7, the main casing 2 further includes a first coupling member 32, a second pressing member 33, a second coupling member 34, and a link member 35.

3.1.1 First Coupling Member 32

Figure 8:
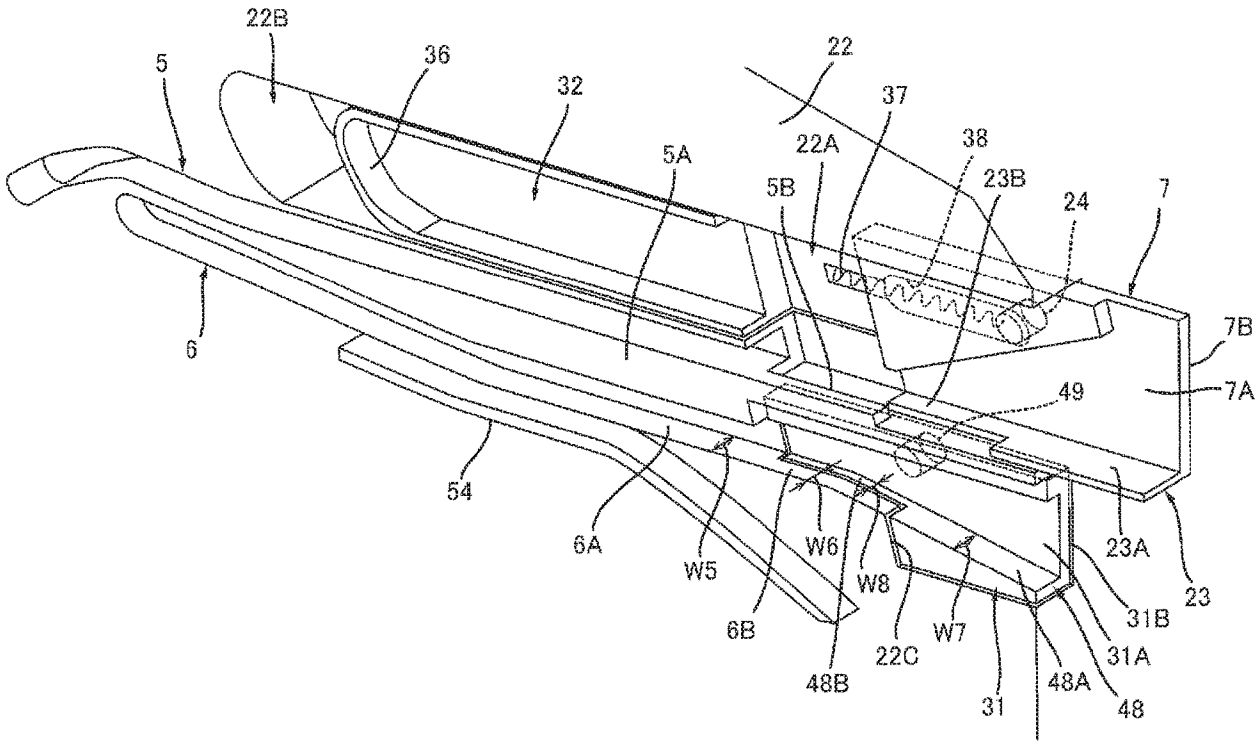
FIG. 8 is a perspective view shows the first guide, the second guide, the third guide, a first coupling member, and the fourth guide shown in FIG. 7.
Figure 9:
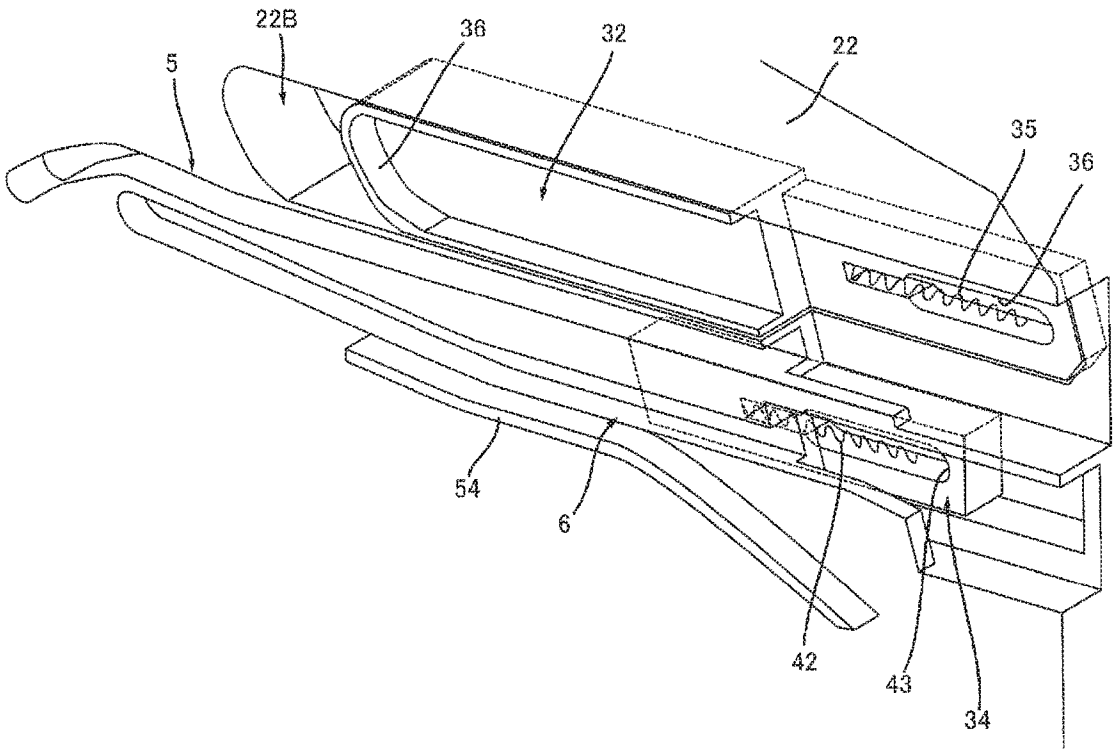
FIG. 9 is a perspective view in which the third guide and the fourth guide shown in FIG. 8 are removed, and showing a second coupling member.

The first coupling member 32 is coupled to the third guide 7 and coupled to one end of the link member 35. The first coupling member 32 is configured to move between a first position (see FIG. 7) at which the third guide 7 is located at the first protruding position and a second position (see FIG. 14) at which the third guide 7 is located at the first accommodated position. The first coupling member 32 is configured to move in the first mounting direction between the first position and the second position. The first coupling member 32 is configured to slide between the first position and the second position. The first coupling member 32 moves from the first position to the second position when the first cartridge 3 is mounted onto the main casing 2. The first coupling member 32 moves from the second position to the first position when the first cartridge 3 is removed from the main casing 2. As shown in FIG. 8, the first coupling member 32 is located in the recessed part 22A and a recessed part 22B formed in the inner surface 22 of the main casing 2. The recessed part 22B is located at the downstream side of the recessed part 22A in the first mounting direction. The recessed part 22B communicates with the recessed part 22A. The first coupling member 32 extends in the first mounting direction. The first coupling member 32 includes a rib 36, a boss 40 (see FIG. 10), and a third pressing member 37. The first coupling member 32 has an elongated hole 38 and an elongated hole 39 (see FIG. 10).

The rib 36 contacts a boss 52 (see FIG. 11A) of the first cartridge 3 described later in the first mounting direction when the first cartridge 3 is mounted onto the main casing 2. The rib 36 is located at a downstream side with respect to the third guide 7 in the first mounting direction. The rib 36 is located away from the third guide 7 in the first mounting direction. The rib 36 protrudes from an inner surface of the first coupling member 32. The rib 36 extends in the width direction and in the upper-lower direction.

Figure 10:
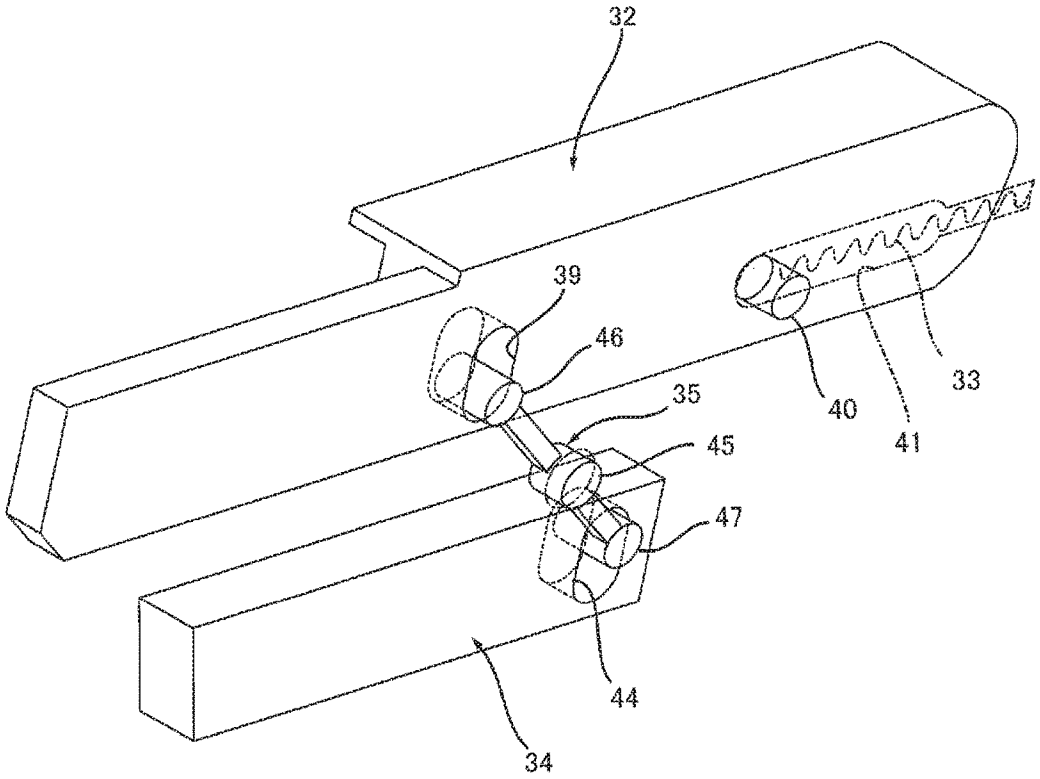
FIG. 10 is a perspective view showing the first coupling member, the second coupling member, and a link member shown in FIG. 7.

As shown in FIG. 10, the boss 40 protrudes from the outer surface of the first coupling member 32. The boss 40 extends in the width direction. The boss 40 has a columnar shape. The boss 40 is fitted in an elongated hole 41. The elongated hole 41 is located in the recessed part 22B (see FIG. 8). The elongated hole 41 extends in the first mounting direction. The boss 40 is fitted in the elongated hole 41 to enable the first coupling member 32 to move in the first mounting direction.

As shown in FIG. 8, the third pressing member 37 presses the third guide 7 (see FIG. 12) located at the first accommodated position toward the first protruding position in a state where the first cartridge 3 is removed from the main casing 2 and the first coupling member 32 is located at the first position. The third pressing member 37 is located at an upstream side with respect to the rib 36 in the first mounting direction. The third pressing member 37 is located away from the rib 36 in the first mounting direction. The third pressing member 37 is located in an elongated hole 38. The third pressing member 37 is configured to be elastically deformed in the moving direction of the third guide 7. More specifically, the third pressing member 37 contacts the boss 24. The third pressing member 37 is compressed in the moving direction of the third guide 7 in a state where the first coupling member 32 is located at the first position and the third guide 7 is located at the first accommodated position. The third pressing member 37 in the compressed state presses the boss 24 by the elastic force. The third pressing member 37 presses the boss 24 in a state where the first coupling member 32 is located at the first position and the third guide 7 is located at the first accommodated position so as to press the third guide 7 toward the first protruding position.

The boss 24 of the third guide 7 is fitted in the elongated hole 38. The elongated hole 38 is located at an upstream side with respect to the rib 36 in the first mounting direction. The elongated hole 38 is located away from the rib 36 in the first mounting direction. The elongated hole 38 extends in the first mounting direction.

As shown in FIG. 10, a first boss 46 of the link member 35 described later is fitted in the elongated hole 39. The elongated hole 39 is located between the rib 36 (see FIG. 8) and the elongated hole 38 (see FIG. 8) in the first mounting direction. The elongated hole 39 is located on the outer surface of the first coupling member 32. The elongated hole 39 extends in the upper-lower direction, i.e., a direction perpendicular to the first mounting direction.

3.1.2 Second Pressing Member 33

Figure 14:
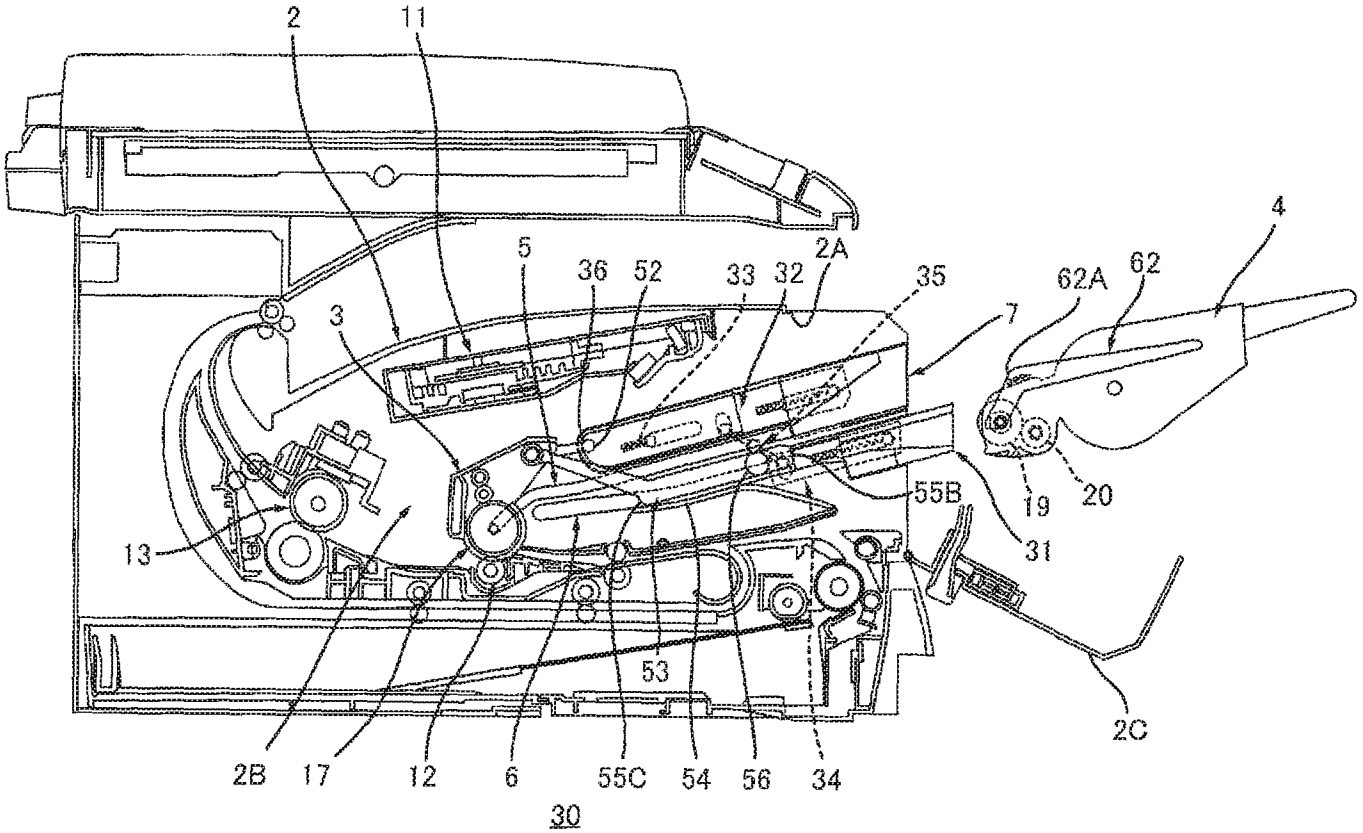
FIG. 14 shows a state where, continuing from FIG. 13, the mounting of the first cartridge onto the casing is completed, the third guide is located at the first accommodated position, and the fourth guide is located at the second protruding position.

As shown in FIG. 14, the second pressing member 33 presses the first coupling member 32 located at the second position toward the first position. As shown in FIG. 10, the second pressing member 33 is located in the elongated hole 41. The second pressing member 33 is configured to be elastically deformed in the moving direction of the first coupling member 32. More specifically, the second pressing member 33 is a spring. The second pressing member 33 extends in the moving direction of the first coupling member 32. The second pressing member 33 contacts the boss 40. The second pressing member 33 is compressed in the moving direction of the first coupling member 32 in a state where the first coupling member 32 is located at the second position. The second pressing member 33 in the compressed state presses the boss 40 by the elastic force. The second pressing member 33 presses the boss 40 in a state where the first coupling member 32 is located at the second position so as to press the first coupling member 32 toward the first protruding position.

3.1.3 Details of Third Guide 7

Figure 12:
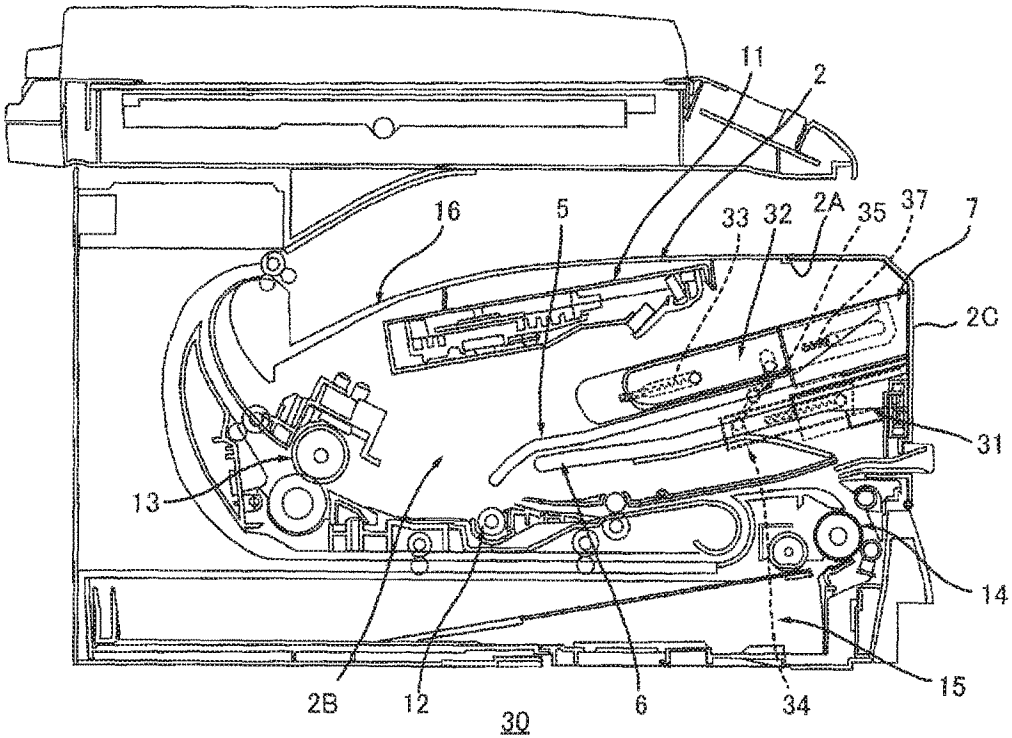
FIG. 12 is an explanatory diagram for explaining mounting of the first cartridge and the second cartridge onto the casing, and shows a state where the first cartridge and the second cartridge are removed from the casing, a cover of the casing is located at a closed position, the first coupling member is located at the first position, and the third guide is located at the first accommodated position, and the fourth guide is located at the second accommodated position.

As shown in FIG. 8, in the second embodiment, the third guide 7 is coupled to the first coupling member 32 such that the third guide 7 moves in the first mounting direction. More specifically, the boss 24 of the third guide 7 is fitted in the elongated hole 38 of the first coupling member 32. In this manner, the third guide 7 is configured to move in the first mounting direction relative to the first coupling member 32. As shown in FIG. 12, the third guide 7 is located at the first accommodated position when the cover 2C is located at the closed position in a state where the first cartridge 3 is removed from the main casing 2 and the first coupling member 32 is located at the first position. As shown in FIG. 7, the third guide 7 is located at the first protruding position when the cover 2C is located at the open position.

3.1.4 Details of Second Guide 6

As shown in FIG. 8, in the second embodiment, the second guide 6 has a guide surface 6A and a guide surface 6B.

When the second cartridge 4 is mounted onto the main casing 2, the guide surface 6A contacts a part of the second cartridge 4 at a downstream side of the guide surface 6B in the second mounting direction. More specifically, the part of the second cartridge 4 is a boss 63 (see FIG. 11B) described later. The guide surface 6A has a width W5.

When the second cartridge 4 is mounted onto the main casing 2, the guide surface 6B contacts a part of the second cartridge 4 at a downstream side of a guide surface 48B described later and an upstream side of the guide surface 6A in the second mounting direction. The guide surface 6B is located at the upstream side of the guide surface 6A in the second mounting direction. The guide surface 6B is continuous with the guide surface 6A. More specifically, the guide surface 6B is continuous with an inner side end of the guide surface 6A in the width direction. The guide surface 6B has a width W6 shorter than the width W5.

3.1.5 Second Coupling Member 34

As shown in FIG. 7, the second coupling member 34 is coupled to the fourth guide 31 and coupled to the other end of the link member 35. The second coupling member 34 is configured to move between a third position (see FIG. 14) at which the fourth guide 31 is located at the second protruding position and a fourth position (see FIG. 7) at which the fourth guide 31 is located at the second accommodated position. The second coupling member 34 is configured to slide between the third position and the fourth position. The second coupling member 34 moves from the fourth position to the third position in conjunction with movement of the first coupling member 32 from the first position to the second position when the first cartridge 3 is mounted onto the main casing 2. The second coupling member 34 moves from the third position to the fourth position in conjunction with movement of the first coupling member 32 from the second position to the first position when the first cartridge 3 is removed from the main casing 2. The second coupling member 34 extends in the second mounting direction. The second coupling member 34 includes a fourth pressing member 42. The second coupling member 34 has an elongated hole 43 and an elongated hole 44 (see FIG. 10).

The fourth pressing member 42 presses the fourth guide 31 (see FIG. 17) located at the second accommodated position toward the second protruding position in a state where the second coupling member 34 is located at the third position. The fourth pressing member 42 is located in the elongated hole 43. The fourth pressing member 42 is configured to be elastically deformed in the moving direction of the fourth guide 31 (see FIG. 8). More specifically, the fourth pressing member 42 is a spring. The fourth pressing member 42 extends in the moving direction of the fourth guide 31. The fourth pressing member 42 contacts a boss 49 (see FIG. 8) of the fourth guide 31 described later. The fourth pressing member 42 is compressed in the moving direction of the fourth guide 31 in a state where the second coupling member 34 is located at the third position and the fourth guide 31 is located at the second accommodated position. The fourth pressing member 42 in the compressed state presses the boss 49 by the elastic force. The fourth pressing member 42 presses the boss 49 in a state where the second coupling member 34 is located at the third position and the fourth guide 31 is located at the second accommodated position so as to press the fourth guide 31 toward the second protruding position.

The boss 49 (see FIG. 8) of the fourth guide 31 is fitted in the elongated hole 43. The elongated hole 43 extends in the second mounting direction.

As shown in FIG. 10, a second boss 47 of the link member 35 described later is fitted in the elongated hole 44. The elongated hole 44 is located on the outer surface of the second coupling member 34. The elongated hole 44 extends in the upper-lower direction.

3.1.6 Link Member 35

As shown in FIG. 7 and FIG. 14, the link member 35 moves the third guide 7 and the fourth guide 31 in an interlocking manner.

More specifically, as shown in FIG. 10, the link member 35 couples the first coupling member 32 and the second coupling member 34. The link member 35 has one end coupled to the first coupling member 32 and the other end coupled to the second coupling member 34. The other end is located away from the one end. The link member 35 is configured to rotationally move with respect to the main casing 2.

In this manner, as shown in FIG. 7 and FIG. 14, when the first cartridge 3 is mounted onto the main casing 2, the first coupling member 32 moves from the first position to the second position, and the link member 35 rotationally moves to cause the second coupling member 34 to move from the fourth position to the third position. At this time, the first coupling member 32 moves from the first position to the second position to cause the third guide 7 to move from the first protruding position to the first accommodated position. The second coupling member 34 moves from the fourth position to the third position to cause the fourth guide 31 to move from the second accommodated position to the second protruding position. That is, when the first cartridge 3 is mounted onto the main casing 2, the link member 35 moves the third guide 7 and the fourth guide 31 in an interlocking manner through the first coupling member 32 and the second coupling member 34.

When the first cartridge 3 is removed from the main casing 2, the first coupling member 32 moves from the second position to the first position, and the link member 35 rotationally moves to cause the second coupling member 34 to move from the third position to the fourth position. At this time, the first coupling member 32 moves from the second position to the first position to cause the third guide 7 to move from the first accommodated position to the first protruding position. The second coupling member 34 moves from the third position to the fourth position to cause the fourth guide 31 to move from the second protruding position to the second accommodated position. That is, when the first cartridge 3 is removed from the main casing 2, the link member 35 moves the third guide 7 and the fourth guide 31 in an interlocking manner through the first coupling member 32 and the second coupling member 34.

As shown in FIG. 10, the link member 35 has a rotational shaft 45, the first boss 46, and the second boss 47.

The rotational shaft 45 is rotationally supported by the main casing 2. The rotational shaft 45 extends in the width direction. The rotational shaft 45 has a columnar shape. The link member 35 is configured to rotationally move about the rotational shaft 45. That is, the link member 35 is configured to rotationally move about an axis line extending in the width direction.

The first boss 46 is located at one end of the link member 35. The first boss 46 extends in the width direction. The first boss 46 has a columnar shape. The first boss 46 is fitted in the elongated hole 39 of the first coupling member 32.

The second boss 47 is located at the other end of the link member 35. The second boss 47 extends in the width direction. The second boss 47 has a columnar shape. The second boss 47 is fitted in the elongated hole 44 of the second coupling member 34.

3.1.7 Details of Fourth Guide 31

Figure 17:
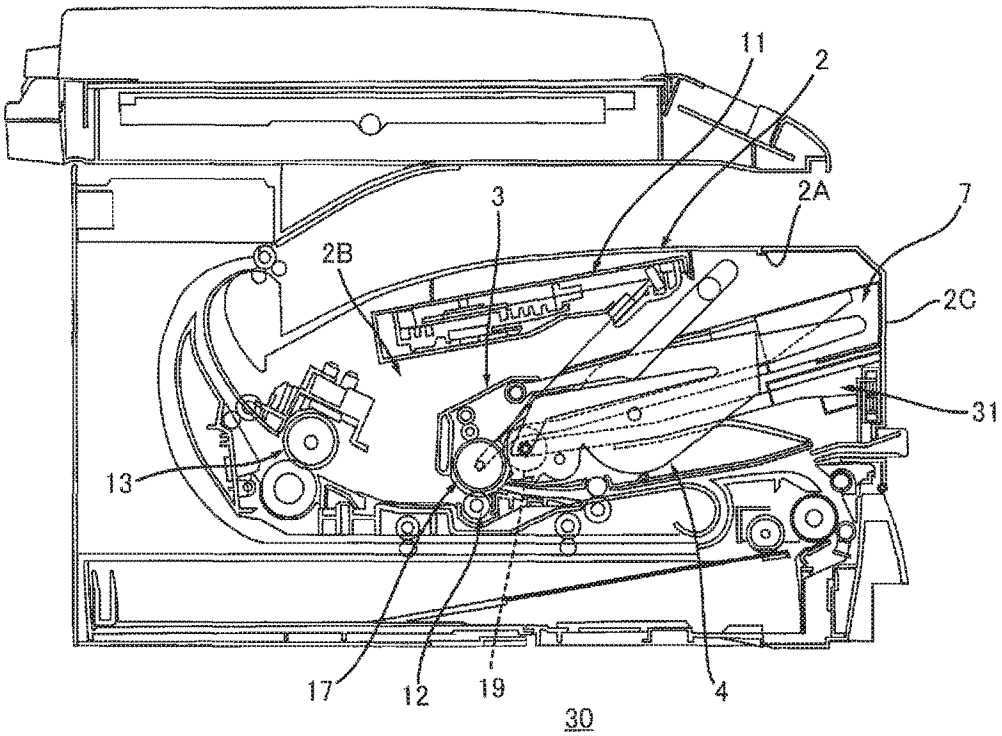
FIG. 17 shows a state where, continuing from FIG. 16, the cover of the casing is located at the closed position, and the fourth guide is located at the second accommodated position.

As shown in FIG. 8, the fourth guide 31 is located below the third guide 7. The fourth guide 31 is located in a recessed part 22C formed in the inner surface 22 of the main casing 2. The fourth guide 31 slides along the second mounting direction between the second protruding position and the second accommodated position. The fourth guide 31 is coupled to the second coupling member 34 (see FIG. 9) such that the fourth guide 31 is configured to move in the second mounting direction. As shown in FIG. 17, the fourth guide 31 is located at the second accommodated position when the cover 2C is located at the closed position in a state where the second coupling member 34 is located at the third position. As shown in FIG. 14, the fourth guide 31 is located at the second protruding position when the cover 2C is located at the open position in a state the second coupling member 34 is located at the third position. As shown in FIG. 8, the fourth guide 31 extends in the second mounting direction and in the upper-lower direction. The fourth guide 31 has a planar shape. The fourth guide 31 has a guide rib 48 and the boss 49. The fourth guide 31 need only have a guide surface 48A and a guide surface 48B described later. The fourth guide 31 may have a guide groove having the guide surface 48A and the guide surface 48B, instead of the guide rib 48.

The guide rib 48 is located at the lower end of the fourth guide 31. The guide rib 48 protrudes from the inner surface 31A of the fourth guide 31. The guide rib 48 has the guide surface 48A and the guide surface 48B.

When the second cartridge 4 is mounted onto the main casing 2, the guide surface 48A contacts a part of the second cartridge 4 at an upstream side of the guide surface 48B in the second mounting direction. The guide surface 48A extends in the second mounting direction and extends in the width direction. More specifically, the guide surface 48A slants with respect to the guide surface 6A of the second guide 6. The guide surface 48A slants in a direction away from the third guide 7 toward the upstream side of the second mounting direction. The guide surface 48A slants downward toward the upstream side of the second mounting direction. The guide surface 48A has a width W7.

When the second cartridge 4 is mounted onto the main casing 2, the guide surface 48B contacts a part of the second cartridge 4 at the downstream side of the guide surface 48A and an upstream side of the guide surface 6B in the second mounting direction. The guide surface 48B is located at the downstream side of the guide surface 48A in the second mounting direction. The guide surface 48B is continuous with the guide surface 48A. More specifically, the guide surface 48B is continuous with an outer side end of the guide surface 48A in the width direction. The guide surface 48B is located outside of the guide surface 6B in the width direction in a state where the fourth guide 31 is located at the second accommodated position. More specifically, the guide surface 48B is located at a position different from the guide surface 6B in the width direction. The guide surface 48B extends in the second mounting direction and extends in the width direction. The guide surface 48B has a width W8 shorter than the width W7. The guide surface 48B is continuous with the guide surface 6B in the second mounting direction in a state where the fourth guide 31 is located at the second protruding position. In this case, the guide surface 48B and the guide surface 6B need only be substantially continuous with each other in the second mounting direction, such that the guide surface 48B and the guide surface 6B can pass (hand over) the part of the second cartridge 4 to each other.

The boss 49 protrudes from an outer surface 31B of the fourth guide 31. The boss 49 extends in the width direction. The boss 49 has a columnar shape. The boss 49 is fitted in the elongated hole 43 (see FIG. 9) of the second coupling member 34. The elongated hole 43 extends in the second mounting direction. The boss 49 is fitted in the elongated hole 43 to enable the fourth guide 31 to move in the second mounting direction with respect to the second coupling member 34.

3.2 Details of First Cartridge

Figure 11A:
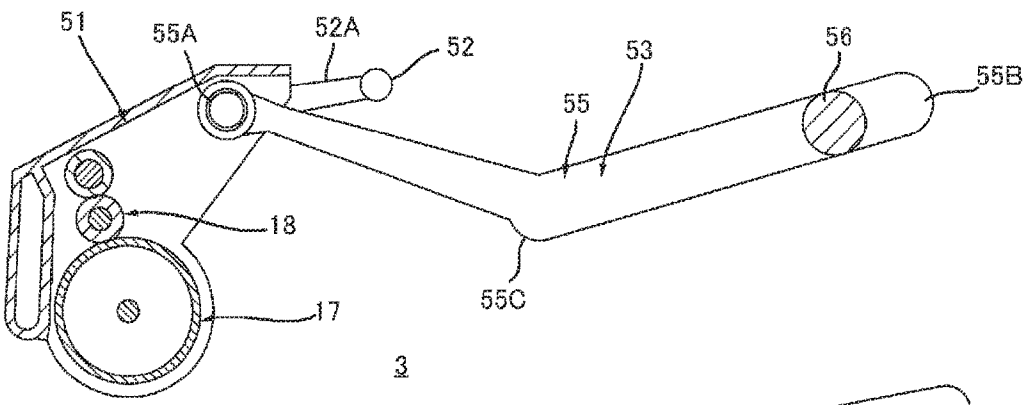
FIG. 11A is a cross-sectional view of the first cartridge shown in FIG. 7.

As shown in FIG. 11A, the first cartridge 3 includes a drum frame 51, a boss 52, and a handle 53.

The drum frame 51 accommodates the photosensitive drum 17 and the charging roller 18.

The boss 52 contacts the rib 36 (see FIG. 8) of the first coupling member 32 when the first cartridge 3 is mounted onto the main casing 2. The boss 52 extends in the width direction. The boss 52 is connected to one end 55A of the handle 53 through an arm 52A.

The handle 53 is attached to the drum frame 51. The handle 53 is configured to rotationally move with respect to the drum frame 51. The handle 53 has a first arm 55, a second arm (not shown), and a grip 56.

The first arm 55 has one end 55A attached to the drum frame 51, an other end 55B located at a position away from the one end, and a contact part 55C. The contact part 55C is located between the one end 55A and the other end 55B. The contact part 55C contacts a rib 54 (see FIG. 14) provided in the main casing 2 in a state where the first cartridge 3 is mounted on the main casing 2. The other end 55B is located with an interval from the rib 54 in the upper-lower direction in a state where the contact part 55C contacts the rib 54.

The second arm (not shown) is located with an interval from the first arm 55 in the width direction. The second arm has the same shape as the first arm 55.

The grip 56 is located between the first arm 55 and the second arm in the width direction. The grip 56 extends in the width direction. The grip 56 has a columnar shape. One end of the grip 56 in the width direction is connected to the first arm 55. The other end of the grip 56 in the width direction is connected to the second arm. In this manner, the grip 56 couples the first arm 55 and the second arm to each other. The grip 56 is located between the contact part 55C and the other end 55B. The grip 56 overlaps the second guide 6 (see FIG. 14) in the width direction in a state where the contact part 55C of the first arm 55 contacts the rib 54 (see FIG. 14). The grip 56 is located almost at the center of the internal space 2B in the upper-lower direction in a state where the contact part 55C of the first arm 55 contacts the rib 54. In this manner, a user can easily hold the grip 56 in a state where the contact part 55C of the first arm 55 contacts the rib 54.

3.3 Details of Second Cartridge 4

Figure 11B:
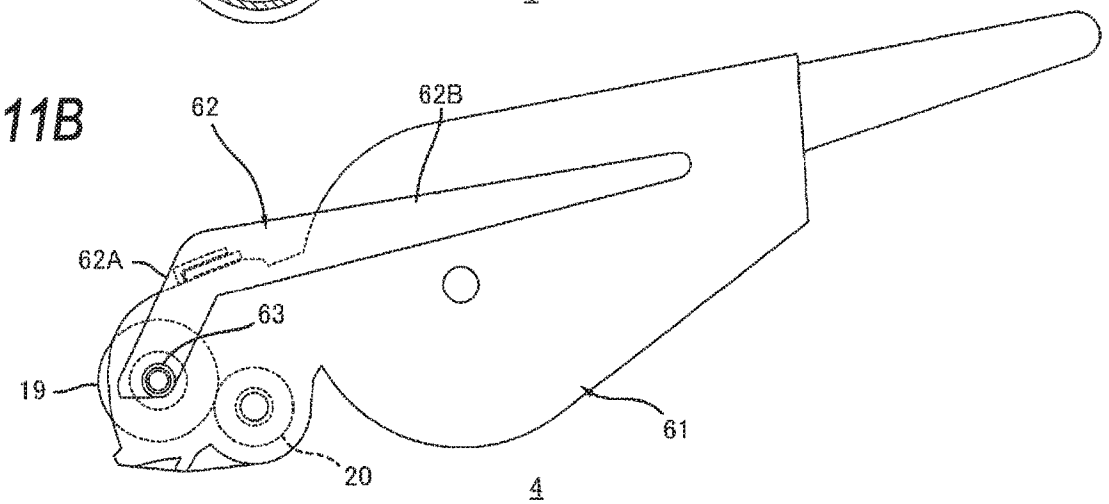
FIG. 11B is a side view of the second cartridge shown in FIG. 7.

As shown in FIG. 11B, the second cartridge 4 has a developing frame 61, a rib 62, and a boss 63.

The developing frame 61 stores toner. The developing frame 61 accommodates the developing roller 19 and the supply roller 20.

The rib 62 contacts the handle 53 of the first cartridge 3 when the second cartridge 4 is mounted onto the main casing 2. The rib 62 is located on an outer surface of the developing frame 61 in the width direction. The rib 62 protrudes from the outer surface of the developing frame 61 in the width direction. The rib 62 has a first contact surface 62A and a second contact surface 62B.

Figure 15:
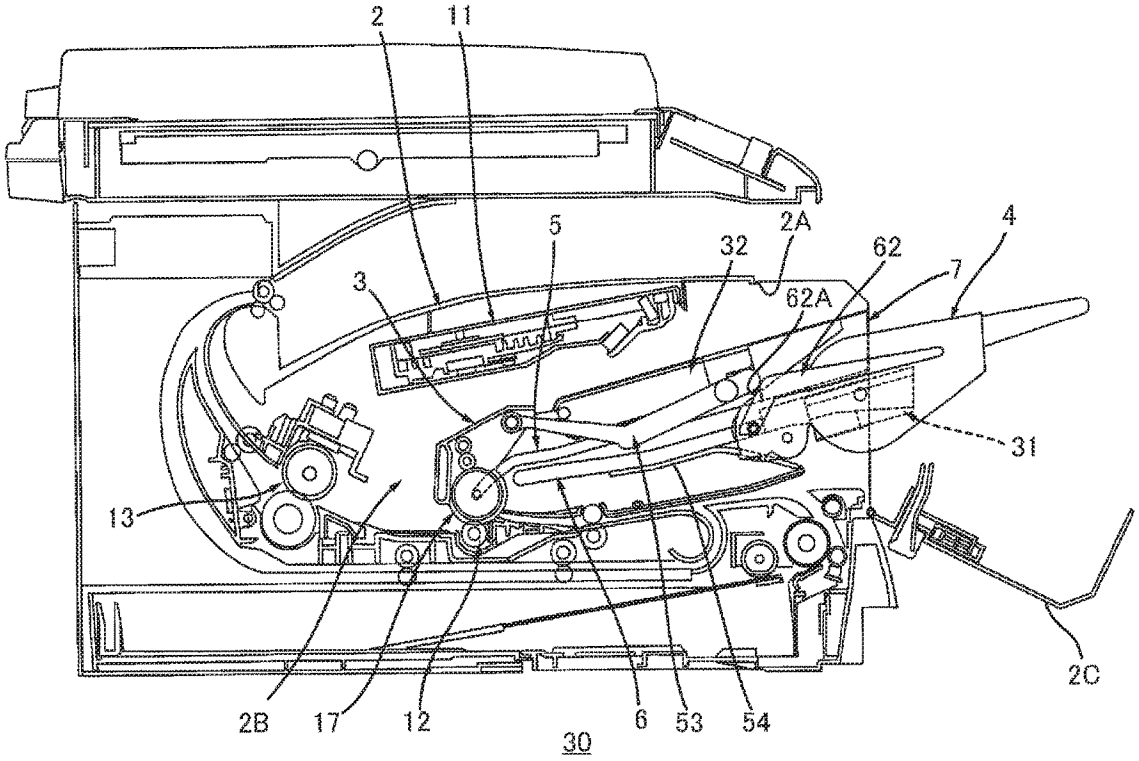
FIG. 15 shows a state where, continuing from FIG. 14, the second cartridge is inserted onto the casing, and a rib of the second cartridge contacts a handle of the first cartridge.

As shown in FIG. 15, when the second cartridge 4 is mounted onto the main casing 2, the first contact surface 62A contacts the handle 53 being in contact with the rib 54 in the main casing 2 to rotationally move the handle 53 upward. The first contact surface 62A slants with respect to the second mounting direction when the second cartridge 4 is mounted onto the casing 2. More specifically, the first contact surface 62A slants upward toward the upstream side in the second mounting direction when the second cartridge 4 is mounted onto the main casing 2.

Figure 16:
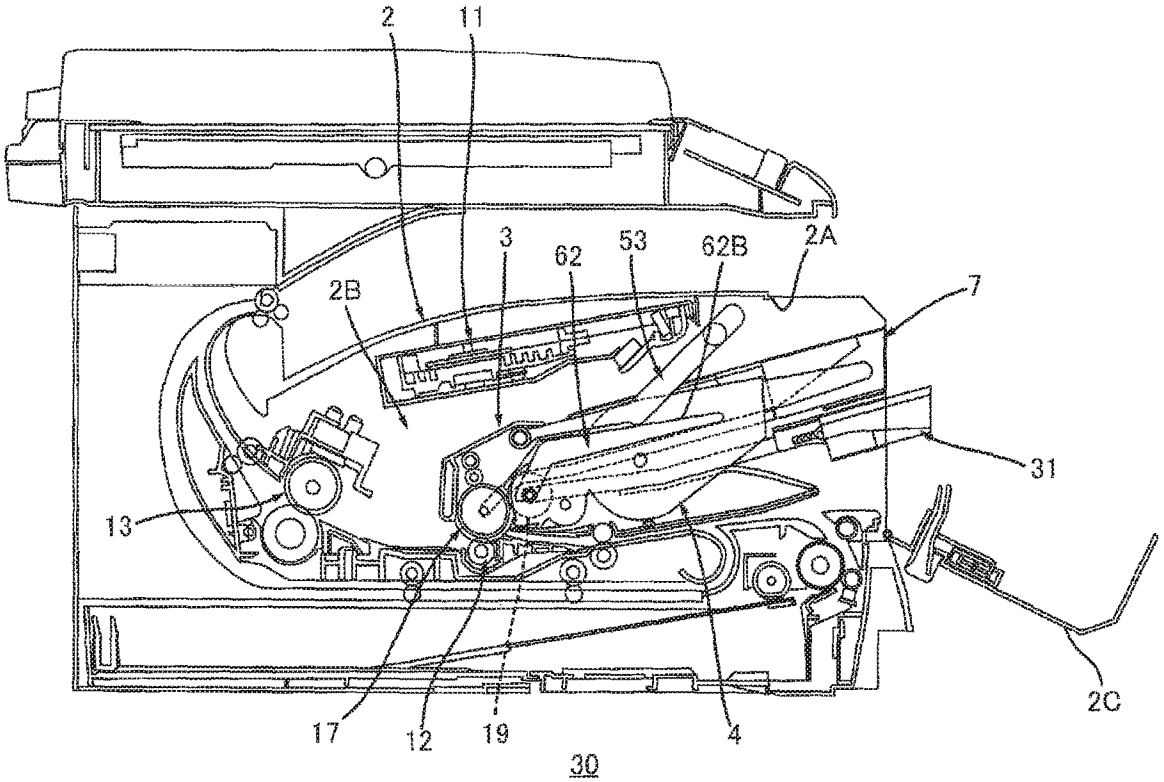
FIG. 16 shows a state where, continuing from FIG. 15, the mounting of the second cartridge onto the casing is completed.

As shown in FIG. 16, the second contact surface 62B contacts the contact part 55C of the handle 53 rotationally moved by the first contact surface 62A in a state where the second cartridge 4 is mounted on the main casing 2. The second contact surface 62B extends in the second mounting direction in the state where the second cartridge 4 is mounted on the main casing 2.

The boss 63 shown in FIG. 11B is fitted in the second guide 6 (see FIG. 8) when the second cartridge 4 is mounted onto the main casing 2. The boss 63 protrudes from the outer surface of the developing frame 61 in the width direction. The boss 63 is located outside the rib 62 in the width direction. The boss 63 extends in the width direction. The boss 63 has a cylindrical shape.

3.4 Mounting of First Cartridge 3 and Second Cartridge 4

In the second embodiment, in order to mount the first cartridge 3 and the second cartridge 4 onto the main casing 2, as shown in FIG. 12 and FIG. 7, the user locates the cover 2C at the open position.

At this time, the cover 2C is located at the open position, and the third pressing member 37 moves the third guide 7 relative to the first coupling member 32 to locate the third guide 7 at the first protruding position.

In this manner, the user can recognize that the first cartridge 3 should be fitted in the third guide 7, not in the fourth guide 31.

When the user fits the first cartridge 3 in the third guide 7 and presses the first cartridge 3 in the first mounting direction, the first cartridge 3 is guided by the third guide 7 and then guided by the first guide 5 to move in the first mounting direction.

Figure 13:
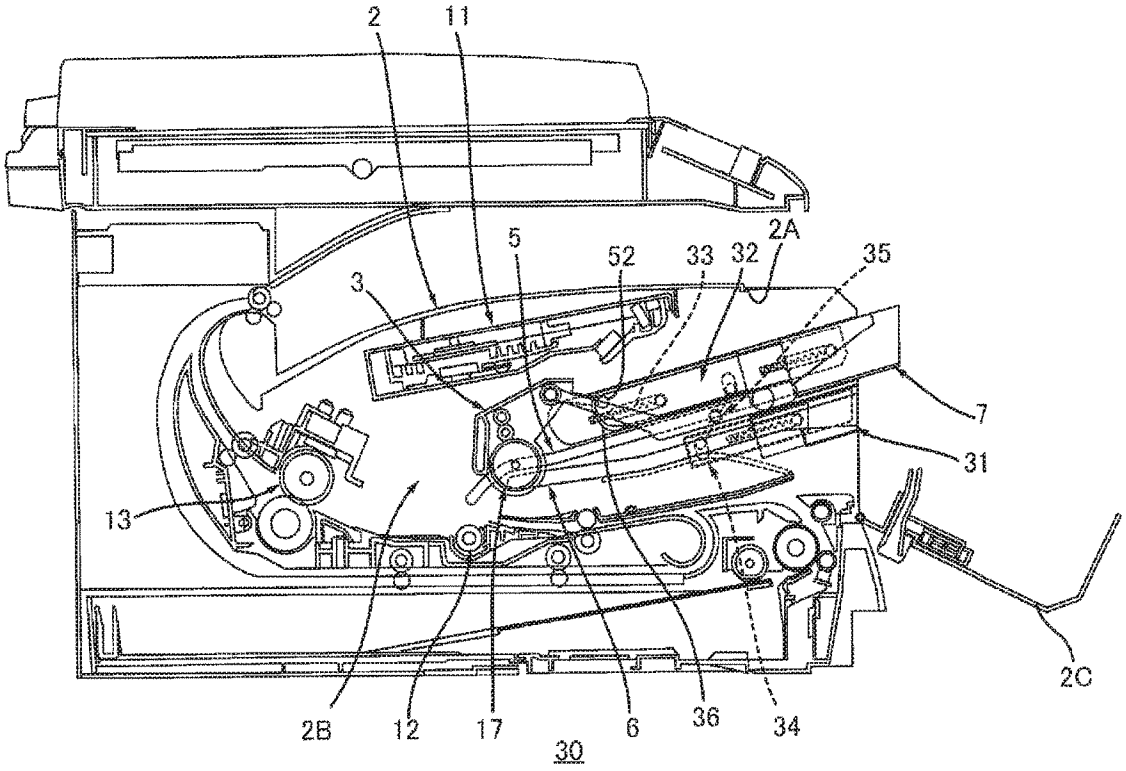
FIG. 13 shows a state where, continuing from FIG. 12, the first cartridge is inserted onto the casing, and a boss of the first cartridge contacts a rib of the first coupling member.

At this time, as shown in FIG. 13, the boss 52 of the first cartridge 3 contacts the rib 36 of the first coupling member 32.

When the user further presses the first cartridge 3 in the first mounting direction, as shown in FIG. 14, the first cartridge 3 is located at a position at which the photosensitive drum 17 contacts the transfer roller 12.

At this time, the first coupling member 32 moves together with the first cartridge 3 while the boss 52 contacts the rib 36, and the first coupling member 32 moves from the first position to the second position against elastic force of the second pressing member 33. When the first coupling member 32 is located at the second position, the third guide 7 is located at the first accommodated position.

At this time, when the first coupling member 32 moves from the first position to the second position, the link member 35 rotationally moves, and the second coupling member 34 moves from the fourth position to the third position. When the second coupling member 34 is located at the third position, the fourth guide 31 is located at the second protruding position.

In this manner, the mounting of the first cartridge 3 onto the main casing 2 is completed, and the user can recognize that the second cartridge 4 should be fitted in the fourth guide 3.

When the user fits the second cartridge 4 in the fourth guide 31 and presses the second cartridge 4 in the second mounting direction, the second cartridge 4 is guided by the fourth guide 31 and then guided by the second guide 6 to move in the second mounting direction.

In this case, the handle 53 of the first cartridge 3 mounted on the main casing 2 overlaps the second guide 6 in the width direction. For this reason, when the second cartridge 4 moves in the second mounting direction, the second cartridge 4 contacts the handle 53. At this time, the first contact surface 62A of the rib 62 of the second cartridge 4 contacts the handle 53.

At this time, as shown in FIG. 15, the handle 53 rotationally moves upward due to the inclination of the first contact surface 62A. The second cartridge 4 moves in the second mounting direction below the handle 53 that is rotationally moved, and, as shown in FIG. 16, the developing roller 19 is located at a position at which the developing roller 19 contacts the photosensitive drum 17. The handle 53 is supported by the second contact surface 62B of the rib 62 in the state where the developing roller 19 is located at the position at which the developing roller 19 contacts the photosensitive drum 17.

In this manner, the mounting of the second cartridge 4 onto the main casing 2 is completed.

Thereafter, when the user locates the cover 2C at the closed position, as shown in FIG. 17, the cover 2C contacts the fourth guide 31 to cause the fourth guide 31 to move relative to the first guide 5 and to be located at the second accommodated position, and the cover 2C is located at the closed position.

In this manner, the mounting of the first cartridge 3 and the second cartridge 4 onto the main casing 2 is completed.

3.5 Operations and Advantageous Effects

Also in the second embodiment, the same operational advantage as in the first embodiment can be obtained.

4. Modification

While the disclosure has been described in detail with reference to the above aspects thereof, it would be apparent to those skilled in the art that various changes and modifications may be made therein without departing from the scope of the claims.

For example, in the first embodiment and the second embodiment described above, the first cartridge 3 is a drum cartridge, and the second cartridge 4 is a developing cartridge. However, the first cartridge 3 is not limited to the drum cartridge, and the second cartridge 4 is not limited to the developing cartridge. For example, the first cartridge 3 may be a process cartridge including a photosensitive drum and a developing unit, and the second cartridge 4 may be a toner cartridge mounted onto the main casing 2 independently from the process cartridge, the toner cartridge storing toner to be supplied to the developing unit.

What is claimed is:

1. An image forming apparatus comprising:

a main casing;

a first cartridge configured to be mounted on the main casing; and a second cartridge configured to be mounted on the main casing independently from the first cartridge, the main casing comprising:

a first guide configured to guide the first cartridge when the first cartridge is mounted onto the main casing, the first guide being located in the main casing;

a second guide configured to guide the second cartridge when the second cartridge is mounted onto the main casing, the second guide being located in the main casing; and a third guide located at an upstream side of the first guide in a first mounting direction that is a direction in which the first cartridge is guided by the first guide when the first cartridge is mounted onto the main casing, the third guide being configured to guide the first cartridge toward the first guide when the first cartridge is mounted onto the main casing, the third guide being configured to move relative to the second guide between a first protruding position at which the third guide protrudes to outside the main casing and a first accommodated position at which the third guide is accommodated in the main casing.

2. The image forming apparatus according to claim 1, wherein the third guide has a guide surface extending in the first mounting direction and in a width direction that intersects both the first mounting direction and an upper-lower direction.

3. The image forming apparatus according to claim 1, wherein the first cartridge is a drum cartridge including a photosensitive drum; and wherein the second cartridge is a developing cartridge including a developing roller.

4. The image forming apparatus according to claim 1, wherein the third guide is configured to slide along the first mounting direction between the first protruding position and the first accommodated position.

5. The image forming apparatus according to claim 1, wherein the third guide is continuous with the first guide in the first mounting direction in a state where the third guide is located at the first protruding position.

6. The image forming apparatus according to claim 5, wherein the first guide has:

a first guide surface having a first width; and a second guide surface having a second width smaller than the first width, the second guide surface being located at an upstream side of the first guide surface in the first mounting direction;

wherein the third guide has:

a third guide surface having a third width; and a fourth guide surface having a fourth width smaller than the third width, the fourth guide surface being located at a downstream side of the third guide surface in the first mounting direction; and wherein, in a state where the third guide is located at the first protruding position, the fourth guide surface is located at a position different from the second guide surface in the width direction.

7. The image forming apparatus according to claim 6, wherein, in a state where the first cartridge is accommodated in the main casing, the fourth guide surface is located at an opposite side from the first cartridge with respect to the second guide surface in the width direction.

8. The image forming apparatus according to claim 1, wherein the main casing further comprises a pressing member configured to press the third guide located at the first accommodated position toward the first protruding position.

9. The image forming apparatus according to claim 1, wherein the main casing further comprises a fourth guide located at an upstream side of the second guide in a second mounting direction that is a direction in which the second cartridge is guided by the second guide when the second cartridge is mounted onto the main casing, the fourth guide being configured to guide the second cartridge toward the second guide when the second cartridge is mounted onto the main casing, the fourth guide being configured to move relative to the first guide between a second protruding position at which the fourth guide protrudes to outside the main casing and a second accommodated position at which the fourth guide is accommodated in the main casing; and wherein the fourth guide is configured to be located at the second accommodated position when the third guide is located at the first protruding position, and to be located at the second protruding position when the third guide is located at the first accommodated position.

10. The image forming apparatus according to claim 9, wherein the fourth guide is configured to slide along the second mounting direction between the second protruding position and the second accommodated position.

11. The image forming apparatus according to claim 9, further comprising a link member configured to move the third guide and the fourth guide in an interlocking manner.

12. The image forming apparatus according to claim 11, wherein the link member has one end and an other end located away from the one end, the link member being configured to rotationally move relative to the main casing; and wherein the main casing further comprises:

a first coupling member coupled to the third guide and coupled to the one end of the link member, the first coupling member being configured to move between a first position at which the first coupling member locates the third guide at the first protruding position and a second position at which the first coupling member locates the third guide at the first accommodated position; and a second coupling member coupled to the fourth guide and coupled to the other end of the link member, the second coupling member being configured to move between a third position at which the second coupling member locates the fourth guide at the second protruding position and a fourth position at which the second coupling member locates the fourth guide at the second accommodated position.

13. The image forming apparatus according to claim 12, wherein the first cartridge has a boss extending in the width direction; and wherein the first coupling member has a rib extending in the width direction, the rib being configured to contact the boss in the first mounting direction when the first cartridge is mounted onto the main casing.

14. The image forming apparatus according to claim 12, wherein the main casing further comprising a pressing member configured to press the first coupling member located at the second position toward the first position.

15. The image forming apparatus according to claim 12, wherein the main casing has an opening through which the first cartridge and the second cartridge are mounted onto the main casing;

wherein the main casing further comprises a cover configured to move between an open position at which the opening is opened and a closed position at which the opening is closed;

wherein the third guide is coupled to the first coupling member such that the third guide moves in the first mounting direction;

wherein the third guide is located at the first accommodated position when the cover is located at the closed position in a state where the first cartridge is removed from the main casing and where the first coupling member is located at the first position, wherein the third guide is located at the first protruding position when the cover is located at the open position; and wherein the first coupling member comprises a pressing member configured to press the third guide located at the first accommodated position toward the first protruding position in a state where the first cartridge is removed from the main casing and where the first coupling member is located at the first position.

16. The image forming apparatus according to claim 12, wherein the main casing has an opening through which the first cartridge and the second cartridge are mounted onto the main casing;

wherein the main casing further comprises a cover configured to move between an open position at which the opening is opened and a closed position at which the opening is closed;

wherein the fourth guide is coupled to the second coupling member such that the fourth guide moves in the second mounting direction;

wherein the fourth guide is located at the second accommodated position when the cover is located at the closed position in a state where the second coupling member is located at the third position;

wherein the fourth guide is located at the second protruding position when the cover is located at the open position; and wherein the second coupling member comprises a pressing member configured to press the fourth guide located at the second accommodated position toward the second protruding position in a state where the second coupling member is located at the third position.

17. The image forming apparatus according to claim 12, wherein the main casing has an opening through which the first cartridge and the second cartridge are mounted onto the main casing;

wherein the main casing further comprises a cover configured to move between an open position at which the opening is opened and a closed position at which the opening is closed;

wherein the fourth guide is coupled to the second coupling member such that the fourth guide moves in the second mounting direction;

wherein the fourth guide is located at the second accommodated position when the cover is located at the closed position in a state where the second coupling member is located at the third position;

wherein the fourth guide is located at the second protruding position when the cover is located at the open position;

wherein the second coupling member comprises a first pressing member configured to press the fourth guide located at the second accommodated position toward the second protruding position in a state where the second coupling member is located at the third position; and wherein the link member is coupled to the first coupling member and to the second coupling member such that:

when the first coupling member moves from the first position to the second position, rotational movement of the link member causes the second coupling member to move from the fourth position to the third position, the third guide moves from the first protruding position to the first accommodated position, and the fourth guide moves from the second accommodated position to the second protruding position by pressing force of the first pressing member; and when the first coupling member moves from the second position to the first position, rotational movement of the link member causes the second coupling member to move from the third position to the fourth position, the third guide moves from the first accommodated position to the first protruding position by pressing force of a second pressing member, and the fourth guide moves from the second protruding position to the second accommodated position.

18. The image forming apparatus according to claim 1, wherein the main casing has an opening through which the first cartridge and the second cartridge are mounted onto the main casing;

wherein the main casing further comprises a cover configured to move between an open position at which the opening is opened and a closed position at which the opening is closed; and wherein the third guide is located at the first accommodated position when the cover is located at the closed position, and is located at the first protruding position when the cover is located at the open position.

* * * * *